US005586924A

United States Patent [19]

Huang

[11] Patent Number: 5,586,924

[45] Date of Patent: Dec. 24, 1996

[54] TOY CAR STRUCTURE

[75] Inventor: Tien F. Huang, Taipei, Taiwan

[73] Assignee: Wen Ho Tsai, Taipei, Taiwan

[21] Appl. No.: 591,811

[22] Filed: Jan. 25, 1996

[51] Int. Cl.[6] ..... A63H 29/22

[52] U.S. Cl. ..... 446/462; 446/448; 446/470; 446/487

[58] Field of Search ..... 446/72, 80, 457, 446/470, 471, 484, 487, 462, 448

[56] References Cited

U.S. PATENT DOCUMENTS 4,529,391 7/1985 Hoshino et al. ..... 446/487
4,580,993 4/1986 Ohno ..... 446/487
4,586,911 5/1986 Murakami ..... 446/487
4,623,317 11/1986 Nagano ..... 446/487
4,750,895 6/1988 Shinohara et al. ..... 446/487

*Primary Examiner*—Robert A. Hafer
*Assistant Examiner*—Jeffrey D. Carlson
*Attorney, Agent, or Firm*—Pro-Techtor International

[57] ABSTRACT

A toy car structure including a power source for driving a driving wheel to drive a linkage assembly so as to push a movable casing open or close relative to a fixed casing. A pull rod urged by an extension spring is disposed on inner side of the movable casing. When the movable casing is moved, the pull rod is hooked on the fixed casing to form a pulling relationship. By means of the pulling of the pull rod, a driven board is pushed to push open a movable door of the movable casing so as to exhibit the inner decorative body.

7 Claims, 6 Drawing Sheets

TOY CAR STRUCTURE

BACKGROUND OF THE INVENTION

The present invention relates to a toy car structure, and more particularly to a toy car structure in which a movable casing is pivotably disposed on a fixed casing and a movable door is disposed at a middle portion of the movable casing. When the movable casing is pivoted upward, the movable door is turned outward to exhibit the inner decorative body.

A conventional electric toy car has attractive appearance and simple functions such as self-turning during running on the ground or emitting monotonous light and sound. Such design can hardly satisfy the curiosity of children. Therefore, currently, the toy cars have been designed with more special operations. However, such toy cars often have complicated structures and thus are quite expensive. This makes such toy cars less popular and competitive on the market.

Therefore, it is necessary to provide a toy car which can create versatile operations while being manufactured with simple structure at low cost.

SUMMARY OF THE INVENTION

It is a primary object of the present invention to provide a toy car structure including a power source for driving a driving wheel to drive a linkage assembly so as to push a movable casing open or close relative to a fixed casing. A pull rod urged by an extension spring is disposed on inner side of the movable casing. When the movable casing is moved, the pull rod is hooked on the fixed casing to form a pulling relationship. By means of the pulling of the pull rod, a driven board is pushed to push open a movable door of the movable casing so as to exhibit the inner decorative body. The toy car can create versatile operations and great entertaining effect while being manufactured with simple structure at low cost.

The present invention can be best understood through the following description and accompanying drawings, wherein:

BRIEF DESCRIPTION OF THE DRAWINGS

FIGS. 2-1 and 2-2 are side sectional views of the present invention in a close state;

FIGS. 4-1 and 4-2 are side sectional views of the present invention in which the movable outer housing is moved to the upper dead point.

DETAILED DESCRIPTION OF THE PREFERRED EMBODIMENT

Figure 1:
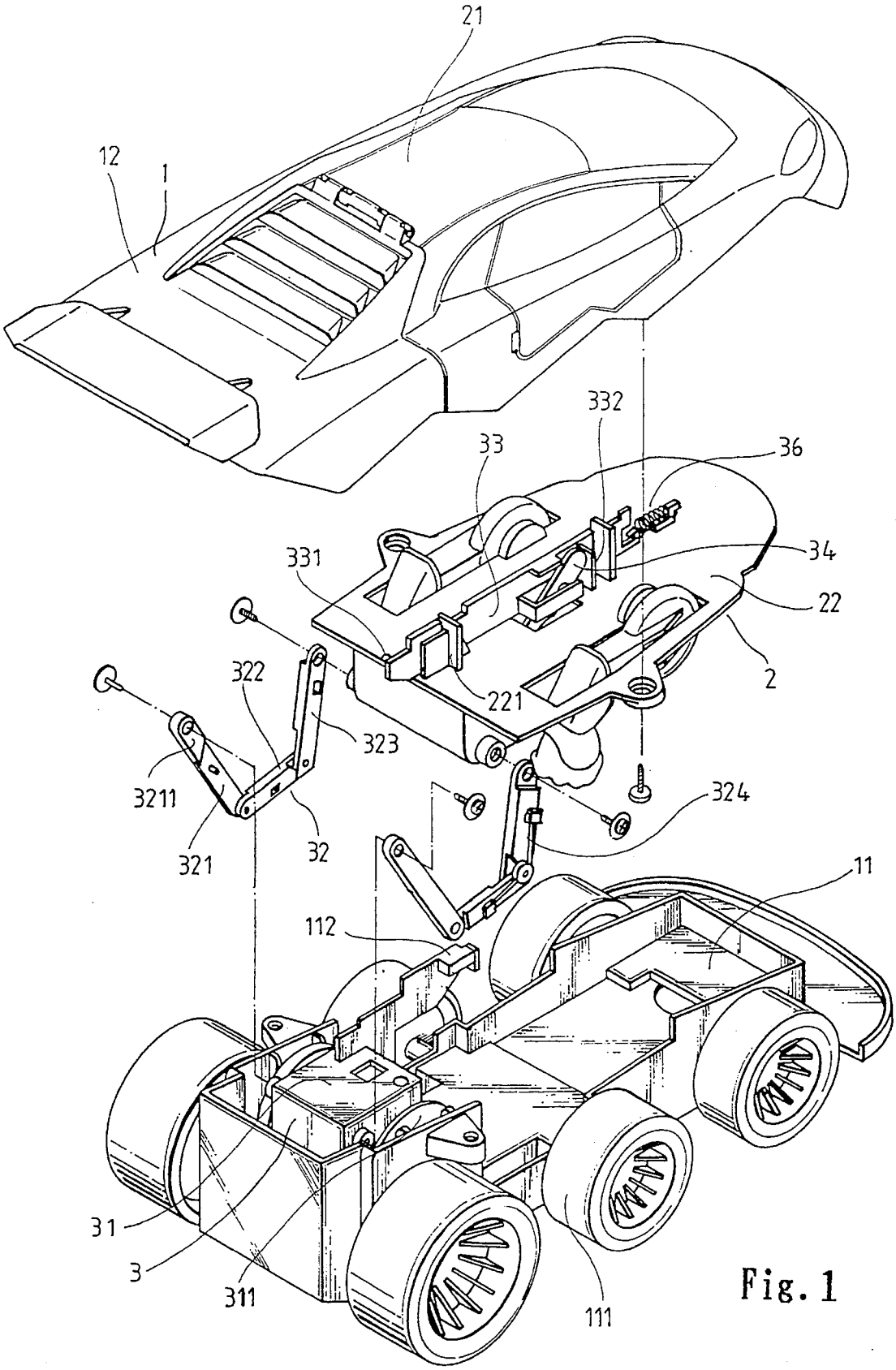
FIG. 1 is a perspective exploded view of the present invention.
Figure 2A:
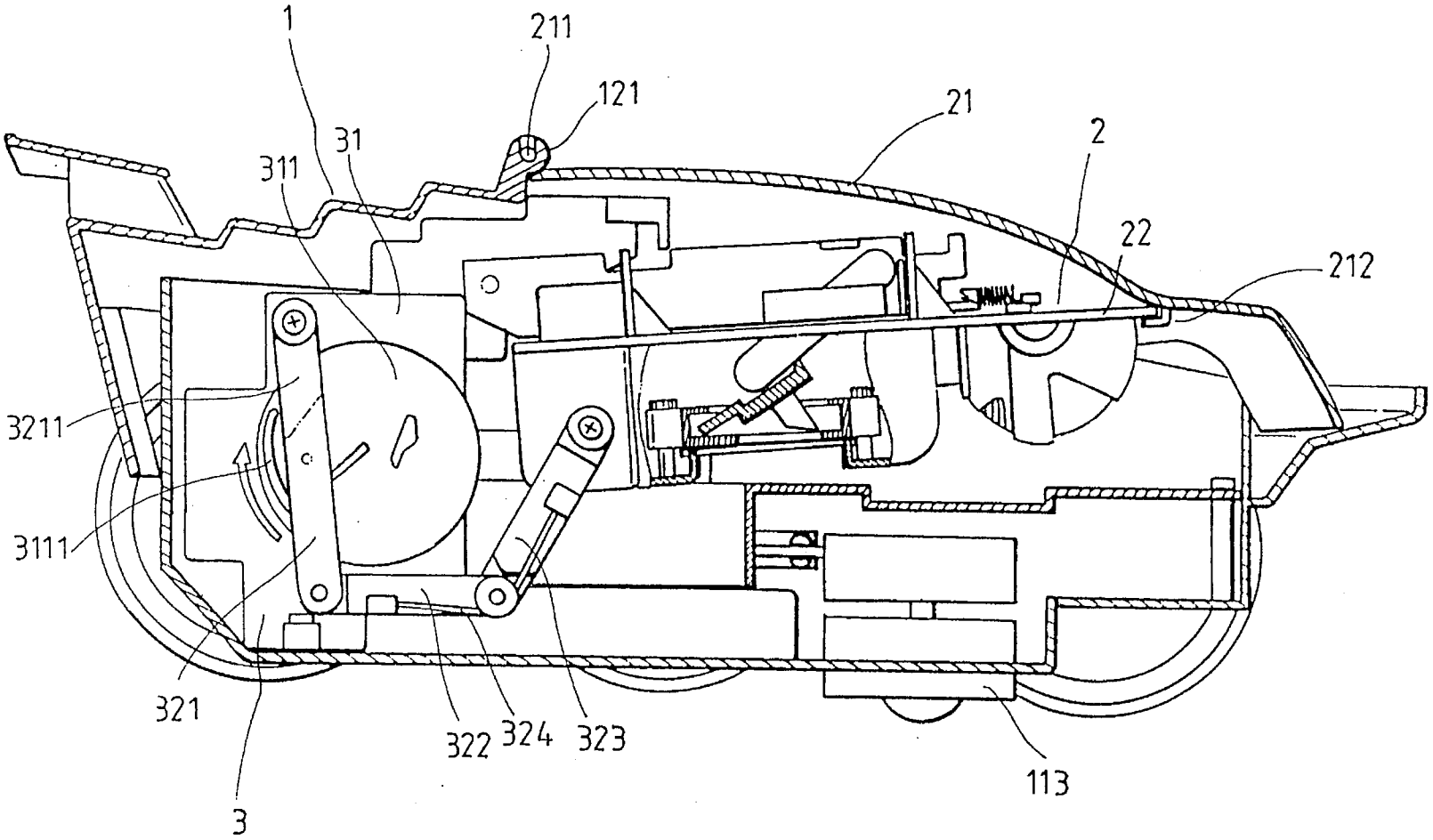
Figure 2B:
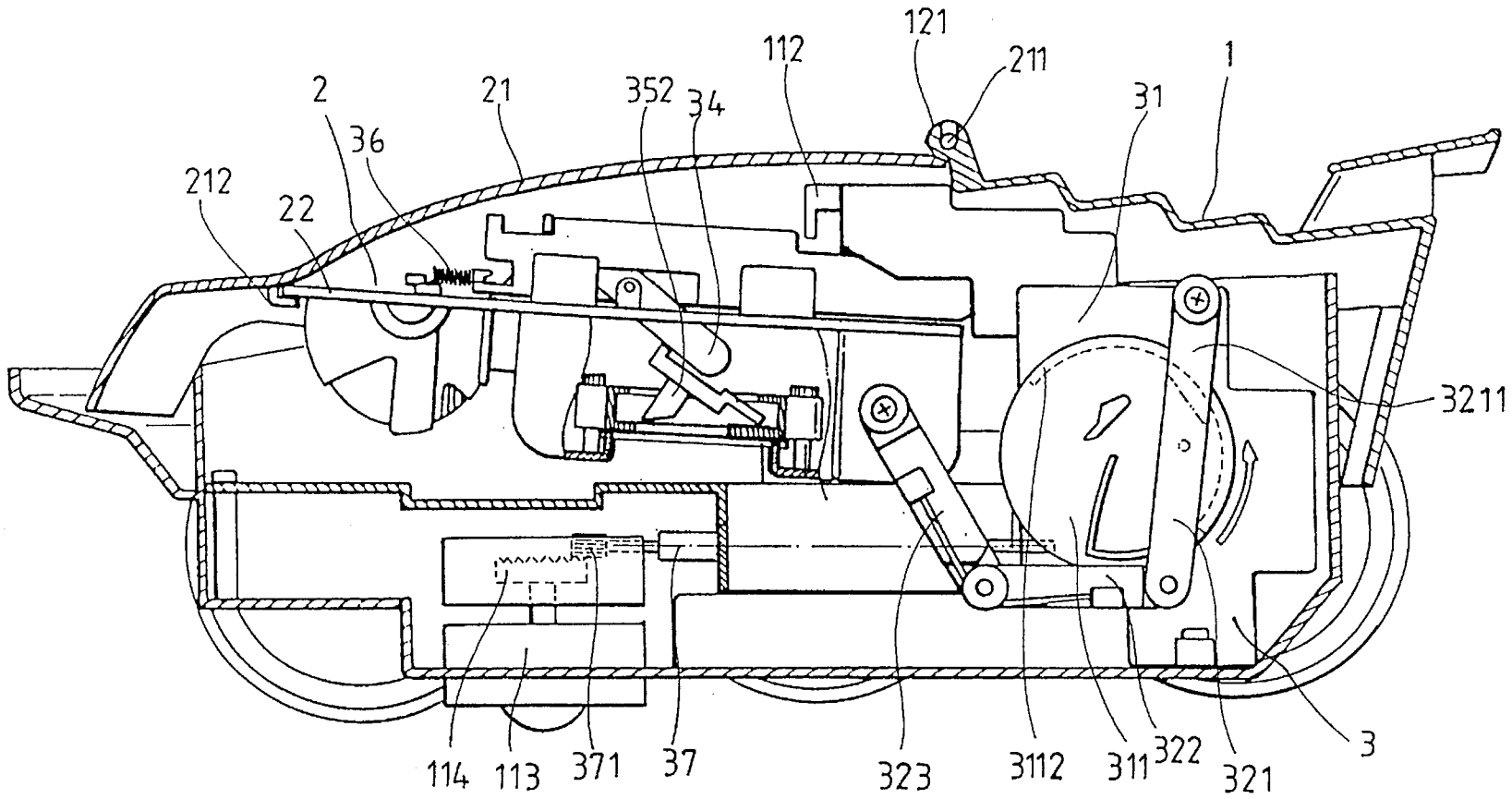

Please refer to FIGS. 1 to 4-2. The present invention includes a fixed casing 1, a movable casing 2 and a driving mechanism 3. The fixed casing 1 includes a chassis 11 and a fixed outer housing 12 secured on a rear side of the chassis 11. Multiple wheels 111 are disposed on two lateral sides of the chassis 11 and a forward extending hook portion 112 is disposed on a top side of the chassis 11. A power wheel assembly 113 is disposed under a bottom side of the chassis 11. A driven gear 114 is disposed above the power wheel assembly 113. A sieve 121 is disposed at one end of the outer housing 12. The movable casing 2 includes a movable outer housing 21 and an inner decorative housing 22. A hook board 212 is disposed on inner side of one end of the movable outer housing 21. A pivot shaft 211 is disposed at the other end of the movable outer housing 21 and pivotally fitted in the sleeve 121. The top end of the inner decorative housing 21 extends into the hook board 212 and two lateral sides of the idler decorative housing 21 are secured by screws to the bottom side of the movable outer housing 21. Multiple supports 221 are disposed on the inner side of the inner decorative housing 22. A movable door 222 held by a restoring spring 223 is disposed on outer side thereof. The driving mechanism 3 includes a power source 31, a linkage assembly 32, a pull rod 33, a driven board 34, a push board 35, an extension spring 36 and a movable rotary shaft 37. The power source 31 is secured in the fixed outer housing 12 and two driving wheels 311 are disposed on two lateral sides of the power source 31 to output the power. Each driving wheel 311 is disposed with an outer flange 3111 on outer side. One of the driving wheels 311 is additionally disposed with an inner flange 3112 on inner side. The linkage assembly 32 is composed of a first linkage 321, a second linkage 322 and a third linkage 323. The end of the first linkage 321 is secured on one side of the driving wheel 311 and the first linkage 321 is disposed with a side projection 3211 for contacting with the outer flange 3111 of the driving wheel 311. The third linkage 323 is connected to one end of the inner decorative housing 22. A locating resilient member 324 is disposed between the second and third linkages 322, 323 so that the second and third linkages 322, 323 can be bent toward each other by a certain angle. The pull rod 33 is fitted in the support 221 of the inner decorative housing 22. The top end of the pull rod 33 is connected to the inner decorative housing 22 by an extension spring 36. The bottom end thereof is disposed with a boss 331. A pressing board 332 is disposed at a middle portion of the pull rod 33. The middle portion of the driven board 34 is supported on the inner decorative housing 22 to form a leverage. One end thereof abuts against the pressing bard 332 and the other end thereof pushes the push board 35 pivotally disposed on inner side of the movable door 222. A forward extending urging rod 351 and a movable decorative body 352 are disposed on the push board 35. The middle portion of the movable rotary shaft 37 is supported under the bottom face of the chassis 11. One end thereof is disposed with a driving gear 371 and the other end thereof is urged by the inner flange 3112 of the driving wheel 311.

Figure 3:
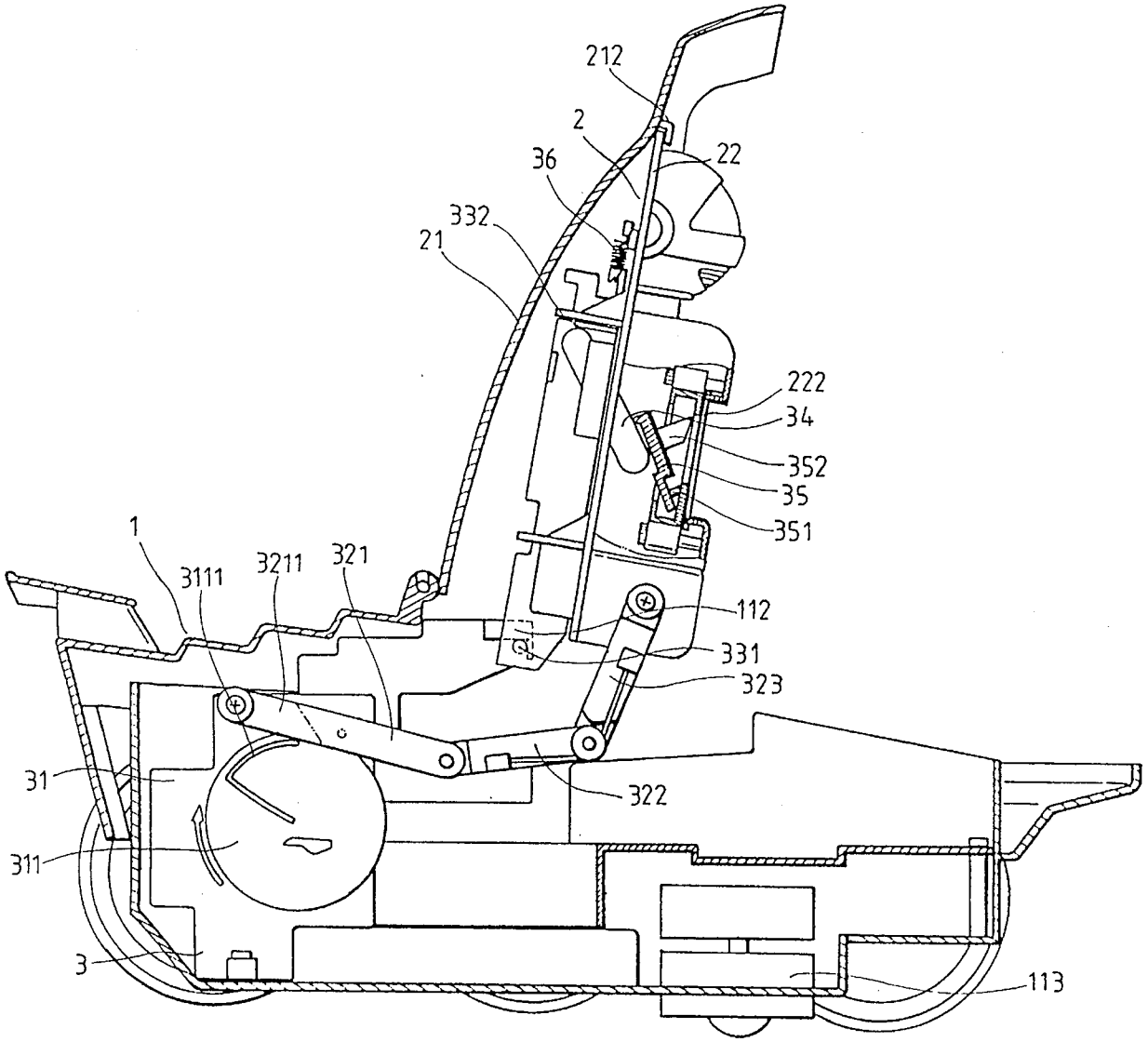
FIG. 3 is a side sectional view showing the operation of the movable outer housing of the present invention.
Figure 4A:
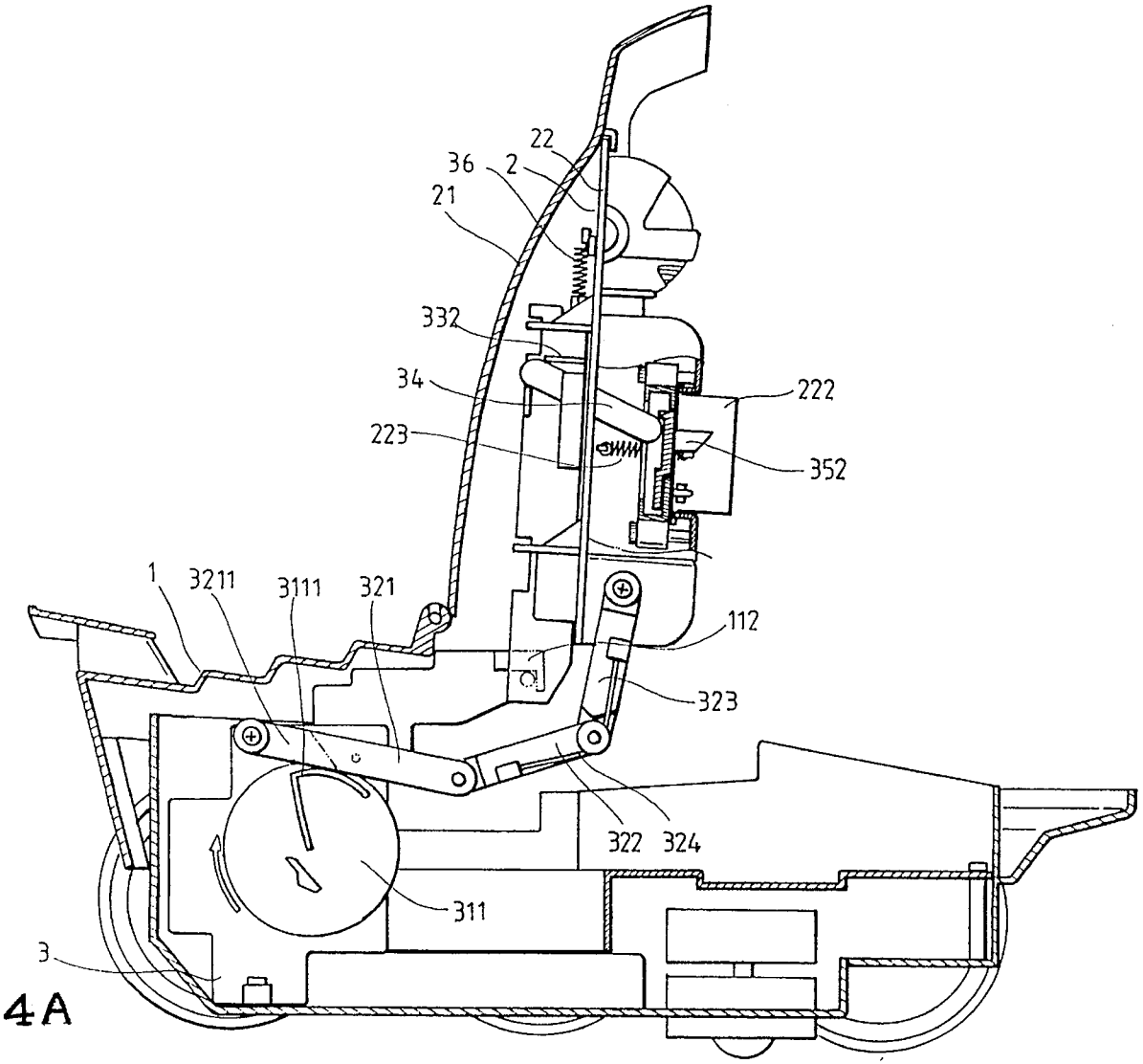
Figure 4B:
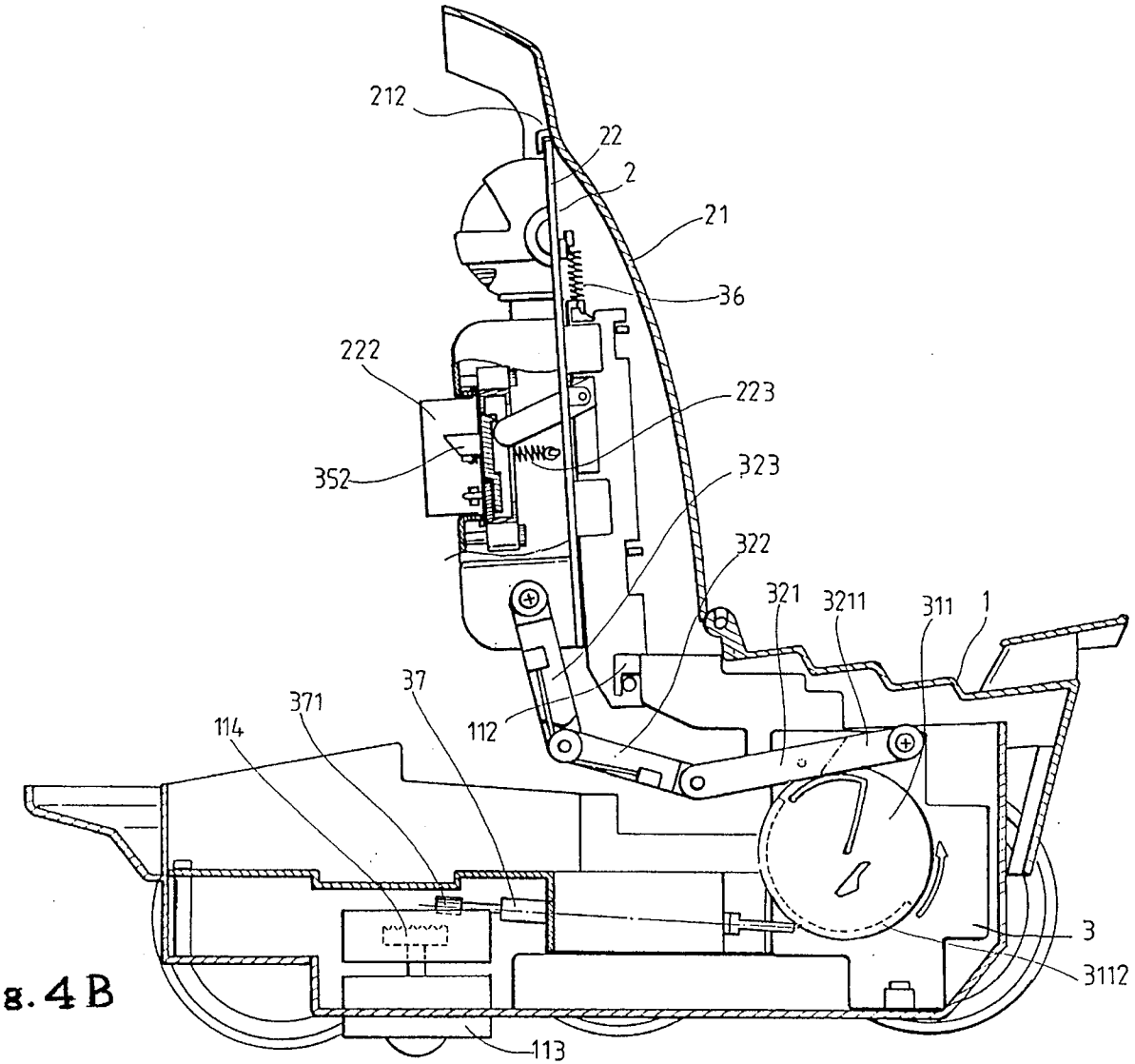

The present invention is operated in such a manner that the power source 31 urges the driving wheel 311 to rotate and the outer flange 3111 of the driving wheel 311 gradually pushes the side projection 3211 of the first linkage 321, making the linkage assembly 32 push and upwardly rotate the movable casing 2 about the pivot shaft 211 so as to gradually show up the inner decorative housing 22 disposed in the movable casing. When the movable casing 2 is rotated upward by a certain angle (not upper dead point), the boss 331 of the pull rod 33 is hooked on the hook portion 112 of the chassis 11 as shown in FIG. 3. At this time, the pull rod 33 is gradually pulled downward following the increment of angle of the upward rotated movable casing 2. The pressing board 332 of the pull red 33 also presses down the driven board 34 to push one end of the push board 35. By means of the rotation of the push board 35, the urging board 351 outward pushes open the movable door 222 and makes the movable decorative body 352 on the push board 351 simultaneously outward move to the outer side of the movable door 222 for exhibition. The inner flange 3112 of the driving wheel 311 presses one end of the movable rotary shaft 37, making the other end thereof with the driving gear 371 lifted and separated from the driven gear 114. At this time, the power wheel assembly 113 is free from power and stops running.

After the driving wheel 311 rotates to make the outer flange 3111 pass through the side projection 3211, the linkage assembly 32 is released from the pushing force and the pull rod 33 is pulled by the extension spring 36 to gradually restore to its home position. Also, the pressing board 332 follows the releasing of the driven board 34 to make the movable door 222 closed by the restoring spring 223 and push back the push board 35. Simultaneously, by means of the reaction force of the boss 331 against the hook portion 112, the movable casing 2 is closed downward until the boss 331 separates from the hook portion 112. Thereafter, the movable casing 2 itself covers the chassis 11 by gravitational force. When the inner flange 3112 does not abut against the movable rotary shaft 37, the driving gear 371 of the movable rotary shaft 37 is downward engaged with the driven gear 114 of the power wheel assembly 113 so that by means of the driving of the movable rotary shaft 37, the power wheel assembly 113 can run on the ground.

It should be noted that many modifications of the above preferred embodiment can be made without departing from the spirit of the present invention. The scope of the present invention should be defined only by the appended claim.

What is claimed is:

1. A toy car structure comprising:

a fixed casing including a chassis and a fixed outer housing secured thereon, a power wheel assembly being disposed under a bottom side of the chassis and multiple decorative wheels being disposed on lateral sides thereof, a hook portion being disposed at one end of the fixed outer housing;

a movable casing including a movable outer housing and an inner decorative housing secured therein, the end of the outer housing being pivotally connected with the top of the fixed outer housing by a pivot shaft, a movable door held by a restoring spring being disposed on an outer side of the inner decorative housing and outwardly pivotable for showing the inner decorative housing; and a driving mechanism including a power source fixed in the fixed casing to output power through two driving wheels and a movable rotary shaft, each driving wheel being disposed with an outer flange and inner flange, the outer flange driving a linkage assembly connected to the end of the inner decorative housing to push the movable casing open the middle portion of the movable rotary shaft being supported on the chassis and one end thereof being intermittently pressed by the inner flange of the driving wheel so as to change the engagement between the movable rotary shaft and the power wheel assembly for intermittent rotation and running.

2. A toy car structure as claimed in claim 1, wherein a pull rod is disposed between the inner decorative housing and movable outer housing and urged by a resilient member at one end, the other end of the pull red being disposed with a boss to be hooked on the hook portion of the fixed casing when the movable outer housing moves upward, a pressing beard being disposed on a middle portion of the pull rod, the pressing board following the movement of the pull rod driving a driven board and push board to upwardly push the movable door of the inner decorative housing for exhibiting the inner decorative body.

3. A toy car structure as claimed in claim 2, wherein the driven beard is fixed at middle portion to form a leverage and two ends of the driven board are respectively connected with the pressing board and push board.

4. A toy car structure as claimed in claim 2, wherein one end of the push board is rotatably supported on an inner side of the movable door.

5. A toy car structure as claimed in claim 1, wherein the linkage assembly includes three linkages.

6. A toy car structure as claimed in claim 5, wherein between two of the three linkages is disposed a locating resilient member so as to keep the linkages at a fixed angle.

7. A toy car structure as claimed in claim 1, wherein a driven gear is disposed at one end of the power wheel assembly so as to engage with the driving gear of the movable rotary shaft when pressed downward.

* * * * *